US007905296B2

(12) United States Patent
Bennett

(10) Patent No.: US 7,905,296 B2
(45) **Date of Patent: *Mar. 15, 2011**

(54) METHODS AND APPARATUS FOR CONTROLLING HAZARDOUS AND/OR FLAMMABLE MATERIALS

(75) Inventor: Joseph Michael Bennett, Hendersonville, TN (US)

(73) Assignee: Firetrace USA LLC, Scottsdale, AZ (US)

( * ) Notice: Subject to any disclaimer, the term of this patent is extended or adjusted under 35 U.S.C. 154(b) by 888 days.

This patent is subject to a terminal disclaimer.

(21) Appl. No.: 11/423,647

(22) Filed: Jun. 12, 2006

(65) Prior Publication Data

US 2007/0068686 A1 Mar. 29, 2007

Related U.S. Application Data

(63) Continuation of application No. 10/728,223, filed on Dec. 3, 2003, now abandoned, and a continuation-in-part of application No. 09/920,179, filed on Aug. 1, 2001, now abandoned, and a continuation-in-part of application No. 10/443,302, filed on May 21, 2003.

(60) Provisional application No. 60/430,912, filed on Dec. 3, 2002.

(51) Int. Cl.
*A62C 2/00* (2006.01)
*A62C 3/00* (2006.01)

(52) U.S. Cl. ..... 169/46; 169/49; 169/58; 169/62

(58) Field of Classification Search ..... 169/26, 169/28, 45, 46, 58, 62, 49
See application file for complete search history.

(56) References Cited

U.S. PATENT DOCUMENTS 4,121,666 A * 10/1978 Rozniecki ..... 169/62
4,132,271 A * 1/1979 Mikaila ..... 169/62
4,251,579 A * 2/1981 Lee et al. ..... 428/73
4,502,815 A * 3/1985 Scales et al. ..... 405/17
5,762,145 A * 6/1998 Bennett ..... 169/62

* cited by examiner

*Primary Examiner* — Dinh Q Nguyen
(74) *Attorney, Agent, or Firm* — The Noblitt Group PLLC

(57) ABSTRACT

A hazard control system according to various aspects of the present invention comprises a housing configured to contain a control material and deliver the control material to neutralize a hazard in response to a trigger event. In one embodiment, the control material is an extinguishant for retarding fire. The housing contains the extinguishant and includes at least one surface configured to rupture in response to a trigger event, such as an impact. The housing may also include a surface configured to substantially mate with a surface of a vehicle, such as a fuel tank surface.

20 Claims, 11 Drawing Sheets

METHODS AND APPARATUS FOR CONTROLLING HAZARDOUS AND/OR FLAMMABLE MATERIALS

CROSS-REFERENCES TO RELATED APPLICATIONS

This application:

is a continuation of U.S. Nonprovisional patent application Ser. No. 10/728,223, filed on Dec. 3, 2003 now abandoned, which claims the benefit of U.S. Provisional Patent Application No. 60/430,912, filed Dec. 3, 2002;

is a continuation-in-part of U.S. Nonprovisional patent application Ser. No. 09/920,179, filed Aug. 1, 2001 now abandoned; and is a continuation-in-part of U.S. Nonprovisional patent application Ser. No. 10/443,302, filed May 21, 2003;

and incorporates the disclosure of each application by reference.

FIELD OF THE INVENTION

The invention relates to methods and apparatus for controlling hazardous and/or flammable materials and the effects of such materials.

BACKGROUND OF THE INVENTION

Flammable and otherwise hazardous materials play an important role in the everyday lives of most people. Most people encounter flammable materials, such as gasoline, engine oil, and natural gas, and other hazardous materials, such as battery acid and concentrated detergents, without danger. Because the unsafe materials are contained, they typically present no problem for those that are nearby.

When the unsafe materials become uncontained, however, the materials can injure or kill, such as when the container is damaged and the material escapes. For example, hundreds of thousands of vehicular accidents occur each year on American highways. Many accident-related fire events occur when the region of the vehicle containing the fuel tank is impacted in an accident, spilling the fuel contents from the tank in the form of a spray, stream, and eventual pool around the vehicle. The highly ignitable spray mist generated upon impact may be exposed to ignition energy from sparks generated from vehicle deformation on impact for only a fraction of a second. This duration, however, may be long enough to ignite the fuel mist into a possible explosion, or more likely a fireball that ignites a developing pool of fuel surrounding the vehicle and create a more serious threat.

In many cases, the threat of ignition and resultant flame spread only exists for the instant that the sparks from the impact event remain. These events have been noted particularly on several recent automotive and truck designs that were hypothesized, due to tank placement and structural design, to have potentially higher rates of incidences of such events. These high profile examples often lead to spectacular fire events and the higher rates of burn injuries and fatalities when they occur, and have resulted in national discussions on how to prevent their continued occurrence.

Unfortunately, most fire protection technologies are impractical for general highway vehicle or other consumer use, due to cost, complexity, reliability problems, and substantial weight increases. As a result, little has been done to prevent such events in the future. The military, however, has confronted similar events that occur in combat scenarios. In particular, military aircraft that are impacted by anti-aircraft projectiles can develop fires in adjoining bays adjacent to fuel tanks onboard the aircraft. The fuel leaking or spraying from a penetrated tank encounters ignition sources, such as burning incendiary particles deposited by the projectile in the adjoining bay, with resultant fires threatening the interior of the aircraft. Many aircraft losses in combat have been attributed to such events.

As a result, technologies have been developed in recent decades to prevent or suppress such events for newer combat aircraft. One approach to aircraft fire protection uses passive systems. These systems are typically some form of structure that requires no electrical power or other artificial monitoring. These systems function by being impinged directly by the explosion or fire event. They typically provide explosion protection inside the fuel tank or in surrounding compartments around the fuel tank. One of the earliest and most successful variants was the use of flexible reticulated foam in fuel tanks to mitigate explosions. This concept was extensively used successfully in the latter stages of the Vietnam War and became a fixture on many modern era aircraft.

The British military developed several advanced concepts in the early 1970s. These included forming reticulated foam into balls to fill various compartments adjacent to fuel tanks in aircraft (U.K. Patents 1,380,420, 1,445,832, and 1,454,492) that could be coated with substances that swell upon heating to cut off air supply to the fire, and filled with various gaseous and powder extinguishing agents to provide extra fire extinguishing in addition to fire mitigation. The main advantages of such concepts were ease of installation, high reliability due to lack of sophisticated electronics and other devices, and competitive weight penalties in comparison to active fire suppression systems, such as gaseous fire extinguishing and detection systems, with the trade-off depending upon the compartment volume and configuration.

Other passive protection systems use fire suppressants embedded into rigid or semi-rigid panels mounted onto the wall of the fuel tank adjoining and facing an adjacent bay. The panels, when impacted by a projectile penetrating through the aircraft, would rupture locally and release a portion of suppressant into the adjacent bay, extinguishing the beginnings of fuel spray from the damaged fuel tank entering the bay and igniting, or rendering the fuel vapors inert against ignition when coming into contact with the deposited incendiary particles. The panels were developed and demonstrated with gaseous extinguishing agents and various powders (U.K. Patents 1,454,493 and 1,547,568). The panels took the form of hollow panels with cylinders or sachets of suppressant inserted, or balls or sheets of reticulated foam (sometimes sealed in bags with a pressurized gaseous suppressant).

All of these variations showed some level of performance enhancement for a given system volume or weight, but could be offset by increased complexity or increased material, assembly, or installation cost. The most common and simple variations were thin panels with a hexagonal honeycomb sandwich material of kraft paper, aluminum, or Nomex, filled with a fire extinguishing powder and covered with a thin sheet on both faces of aluminum foil, composite fibers, or other materials. These devices were described as powder panels or powder packs.

The powder panels were demonstrated to effectively protect against many large ballistic incendiary threats with as little as 0.1 inch total thickness and 0.2-0.6 pounds mass per square foot. Other threats and conditions could require much thicker, heavier, systems if they worked at all. Some limitations in performance were seen against small threats that limited rupture damage to the panel and as a result limited the amount of powder suppressant released to extinguish the fire.

Variations of this concept were investigated for use against ballistic impacts in armored vehicles (U.S. Pat. Nos. 3,930,541 and 4,132,271), although powders were primarily limited for use in engine compartments due to the inhalation difficulties with crew members, and gaseous suppressant filled panels were used in the crew compartment. Later fine tuning was made including adding spall shields to prevent spallation damage from the panels to crew members.

Since these systems require ballistic impact to function, their utility and consideration was limited to combat-induced ballistic impact events; they offer no protection against gradual fuel system leakage and ignition due to ordinary fuel system failures. Further, such systems do not provide protection against other types of threats or problems. For example, such systems do not provide protection in other fire scenarios, such as collisions impacting and fracturing fuel tank valves and their connectors, particularly for alternate fueled vehicles. Additional flammable fluid reservoirs, such as brake master cylinders and fuel pumps, contain sufficient flammable fluid to pose a threat to vehicle occupants or the vehicle itself, and their small, bulky shapes provide difficulties in providing protection. Other areas of a vehicle, such as the vehicle's engine compartment hood, exhibit damage in front end crashes, and may cause the release of flammable or otherwise hazardous materials. Further, some components, such as the oil pan, may rupture and discharge flammable fluids due to the internal destruction of the engine, which is typically accompanied by the fracturing and penetration of the connecting rods through the oil pan. This scenario is very common in automobile racing in addition to highway occurrences.

SUMMARY OF THE INVENTION

A hazard control system according to various aspects of the present invention comprises a housing configured to contain a control material and deliver the control material to neutralize a hazard in response to a trigger event. In one embodiment, the control material is an extinguishant for retarding fire. The housing contains the extinguishant and includes at least one surface configured to rupture in response to a trigger event, such as an impact. The housing may also include a surface configured to substantially mate with a surface of a vehicle, such as a fuel tank surface.

BRIEF DESCRIPTION OF THE DRAWINGS

A more complete understanding of the present invention may be derived by referring to the detailed description when considered in connection with the following illustrative figures. In the following figures, like reference numbers refer to similar elements and steps.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention is described partly in terms of functional components and various processing steps. Such functional components may be realized by any number of components configured to perform the specified functions and achieve the various results. For example, the present invention may employ various elements, materials, suppressants, neutralizing agents, and the like, which may carry out a variety of functions. In addition, the present invention may be practiced in conjunction with any number of applications, environments, hazardous materials, and trigger events, and the systems described are merely exemplary applications for the invention. Further, the present invention may employ any number of conventional techniques for manufacturing, assembling, mounting, and the like.

Figure 1:
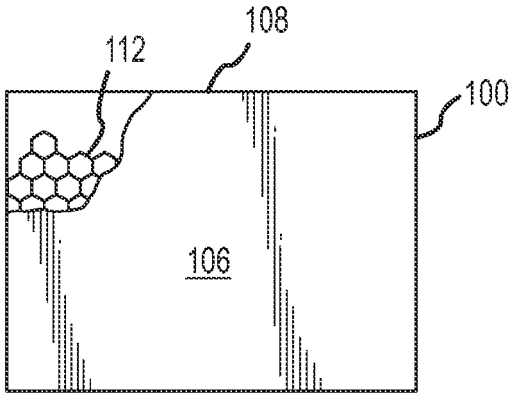
FIG. 1 is an illustration of a hazard control system having a honeycomb core.
Figure 2:
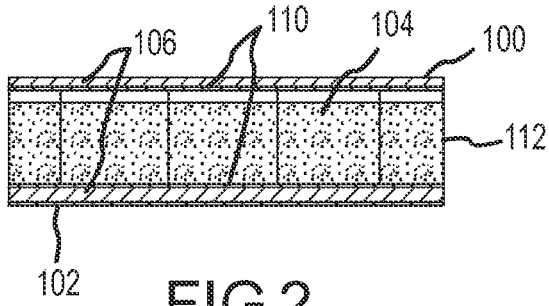
FIG. 2 is a cross-section view of the hazard control system of FIG. 1.

Referring now to FIGS. 1 and 2, a hazard control system 100 for controlling hazardous and/or flammable materials according to various aspects of the present invention may be implemented in conjunction with a housing 102 containing a control material 104. The housing 102 is configured to contain the control material 104 and facilitate dispersal of the control material 104 in response to a trigger event, especially relatively large quantities of control material 104 for relatively large-scale events such as an impact, exposure to heat, or detection of a hazard. The control material 104 comprises one or more materials for controlling a hazard.

The housing 102 may comprise any suitable apparatus for containing the control material 104 and facilitating dispersal of the control material 104 in response to the trigger event. For example, the housing 102 may comprise a container configured to shatter, explode, or otherwise deteriorate, either entirely or in part, upon impact to release the control material 104. In various embodiments, the housing 102 may comprise a rigid structure, a semi-rigid structure, a membrane, or a bladder. The housing 102 may be comprised of any suitable materials, for example glass, ceramic, or plastic that is designed to shatter upon impact. Further, the housing 102 may be configured to promote dispersal of the control material 104, for example by scoring the housing 102 to promote fracturing of the scored surface in the event of an impact. The housing 102 may include additional mechanisms for promoting dispersal of the control material 104, such as one or more spring mechanisms, such as a leaf spring, compressed coil spring, a flat spring, an expandable material, configured to enhance the expansion of the housing 102 when the housing 102 is weakened or fractured by the trigger event. In one embodiment, multiple channels formed in the housing 102 include spring mechanisms to biased against a surface of the housing 102 to be impacted.

In the present embodiment, the housing 102 suitably comprises two face sheets 106 sandwiching the control material 104. The face sheets 106 maintain the control material 104 in position, and may comprise any suitable configuration, such as a rigid sheet, a flexible cover, a flexible bladder, or any other appropriate system for maintaining the control material 104 in a selected position. Further, the face sheets 106 may comprise any appropriate materials, including cellulosic material such as styrene, paper, glass, plastic, metal, ceramic, aluminum, nylon, glass fabric, fiberglass/epoxy, Kevlar, graphite tape, or a composite or combination of such materials. The face sheets 106 are suitably configured to react to a trigger event, such as an impact, a thermal event such as exposure to heat, or an optical event such as exposure to particular radiation. In the present embodiment, the face sheets 106 are suitably configured to substantially completely shatter or otherwise rupture to promote total release of the control material 104. The housing 102 may also comprise malleable materials, so the housing 102 may be shaped and bent to fit various configurations. In the present embodiment, the face sheets 106 are rectangular sheets constructed of a lightweight and cost effective material, such as glass, ceramic, acrylic, and/or epoxy.

The face sheets 106 are suitably mounted on a frame 108 to support the face sheets 106. The frame 108 may comprise any suitable structure, such as a rigid structure joined to the face sheets 106, an adhesive material like a caulk between the face sheets 106, or a rigid spacer. In an alternative embodiment, the frame 108 may be omitted and the face sheets 106 may be otherwise configured to maintain the position of the control material 104. For example, the ends of the face sheets 106 may be taped adhesively, glued, or crimped, or the face sheets 106 may be formed as a single unit, such as using blow molding, vacuum forming, or thermoforming to form the housing 102.

In the present embodiment, the frame 108 is configured to support the face sheets 106 and maintain the control material 104 in position. For example, the frame 108 suitably comprises a rigid structure having the same shape as the face sheets 106 and bonded to the face sheets 106. Thus, in the present embodiment, the frame 108 comprises a rigid rectangular frame 108 configured to support the face sheets 106. In addition, the face sheets 106 may be connected to the frame 108 in any suitable manner, for example using fasteners or a bonding agent. In the present embodiment, the face sheets 106 are bonded using an epoxy 110 or a similar adhesive. Other variations may be used to bond the face sheets 106 to the frame 108, such as hot glues and other chemical adhesives.

The housing 102 may also include a core 112 configured to separate the control material 104 into multiple compartments. The core 112 may also maintain a desired space between the face sheets 106 and support the face sheets 106. The core 112 may be configured in any suitable manner. In the present embodiment, the core 112 may be configured in a honeycomb configuration to form individual compartments. In addition, the core 112 may comprise any appropriate materials, such as lightweight, rigid materials. In the present embodiment, the core 112 comprises aluminum or Nomex.

The housing 102 contains the control material 104. In the present embodiment, the control material 104 is contained in the compartments formed by the core 112. The control material 104 may comprise one or more suitable materials for neutralizing a particular hazard, such as a fire, acid spill, or noxious gas release. For example, to extinguish a fire, the control material 104 may comprise a fire suppressant, such as monoammonium phosphate, mixed with an appropriate desiccant and/or flow enhancer such as a 1% concentration of micronized fumed silica. Alternatively, the suppressant may comprise sodium bicarbonate, potassium bicarbonate, potassium carbonate, urea-based powders, potassium dawsonite, ammonium polyphosphate, monoammonium phosphate, potassium iodide, or other powder suppressants or mixtures, or liquid or gaseous agents, such as water, nitrogen, carbon dioxide, argon, iodotrifluoromethane, heptafluoropropane, pentafluoroethane, or other gaseous agents or mixtures.

The compartments of the core 112 are suitably totally filled to capacity, though some settling may occur after construction and installation, leaving some void space in the core 112. If the compartments are not completely full, the control material 104 may be supplemented with a filler, such as a neutral, non-burning substance to occupy internal volume. In the present embodiment, the filler is configured to cover a large area while adding little weight. The filler may comprise, for example, silica dessicant, glass or plastic microspheres which may be filled with the control material 104 or remain empty, or other suitable lightweight material.

In addition, the control material 104 may be enhanced to facilitate dispersal and/or react to the trigger event. For example, the control material 104 may be pressurized, for example with air, a gaseous control material 104, or other fluid to enhance dispersal of the control material 104. Further, the control material 104 may respond directly to the trigger event. For example, the control material 104 may include an optically reactive, thermally reactive, or impact reactive material that causes the control material 104 to expand or otherwise deploy.

The control material 104 may also be supplemented with or include a propellant to propel the control material 104 out of the housing 102 to enhance delivery. For example, the control material 104 may be supplemented containers of gas, such as ambient or pressurized air or a fire suppressant gas, that when compressed by the impact, burst and provide a gust of air to help disperse the control material 104. The containers may comprise any suitable containers, such as enclosed tubes or balls of thin plastic or other suitable material. Alternatively, the propellant may comprise a material that, when exposed to air, generates an expanding volume of gas to propel the control material 104. The propellant may also comprise a fire suppressant material, such as carbon dioxide. Alternatively, the propellant may include different areas of the housing 102 that may contain separate materials. When the materials react to the trigger event, such as in response to heat or by mixing following rupture of the housing 102, the materials may react to generate a propelling gas and, in some embodiments, a supplemental fire suppressant. For example, the materials may comprise acetic acid and a sodium bicarbonate control material 104, which produces carbon dioxide when mixed. Alternatively, the material may comprise carbonic acid, which reacts to heat, such as due to a fire, by decomposing to water and carbon dioxide. Other materials may be used that create carbon dioxide and water when mixed, such as calcium carbonate and hydrochloric acid, or sodium carbonate and dilute sulfuric acid. Yet other materials may produce a fire suppressant foaming agent. For example, the supplementary material or control material 104 may comprise sodium bicarbonate powder with a licorice additive, which mixed with aluminum sulfate will make a sticky, aluminum hydroxide foam. Other materials may comprise compositions of nitrogen triiodide or nitrogen tribromide powders or solids, possibly mixed with stabilizing binders, which when impacted convert to nitrogen gas and fire suppressing iodine or bromine gas.

Figure 5:
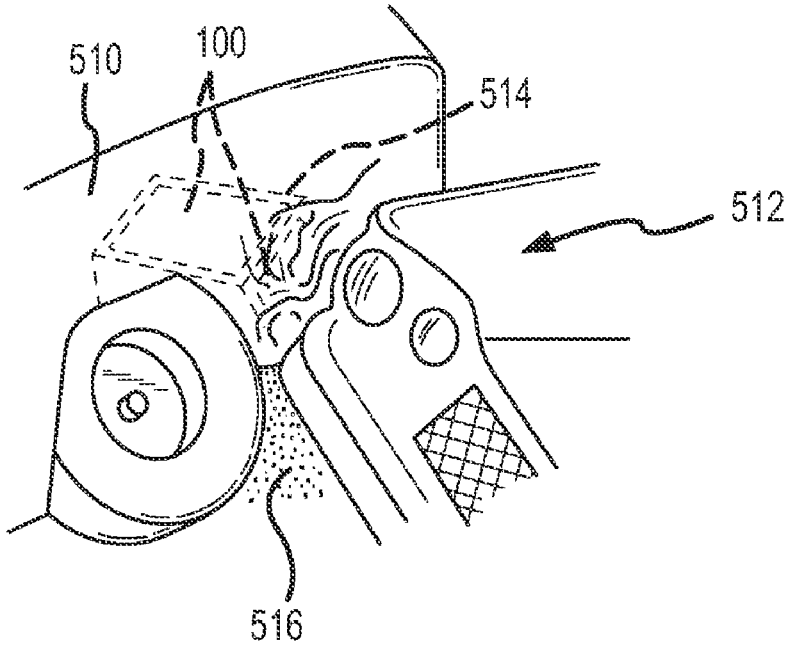
FIG. 5 is an illustration of a crash incident involving impact between two motor vehicles, one of which is equipped with a hazard control system.
Figure 9:
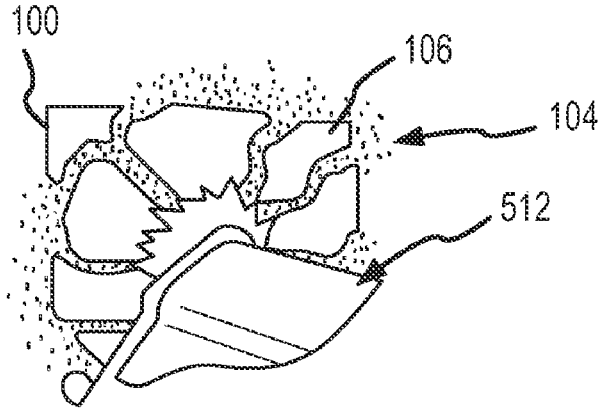
FIG. 9 is an illustration of hazard control system having shattering a face sheet.

The hazard control system 100 may be attached to or integrated into a hazard source, such as a fuel tank or other hazardous material storage unit in a vehicle, such as a car, bus, truck, aircraft, racing car, police car or van, military vehicle or craft, racing boat, rail car, tractor trailer, or heavy equipment. For example, referring to FIGS. 5 and 9, a highway vehicle 510 is suitably equipped with the hazard control system 100 by attaching the hazard control system 100 to the vehicle's fuel tank 514. When the highway vehicle 510 is impacted by a colliding vehicle 512, the exterior of the highway vehicle 510 and the fuel tank 514 deform, also deforming hazard control system 100 attached to the fuel tank 514. When deformed and ruptured, the hazard control system 100 releases the control material 104, such as a suppressant powder 516 comprising monoammonium phosphate, which tends to neutralize the area around the damaged and potentially leaking fuel tank 514 to inhibit fire initiation. The hazard control system 100 may be configured for any suitable environment or application, however, such walls that may be subject to impact, heat, or other hazard, exterior of buildings, near airport runways, within or upon hazardous material transports, and the like.

Figure 6:
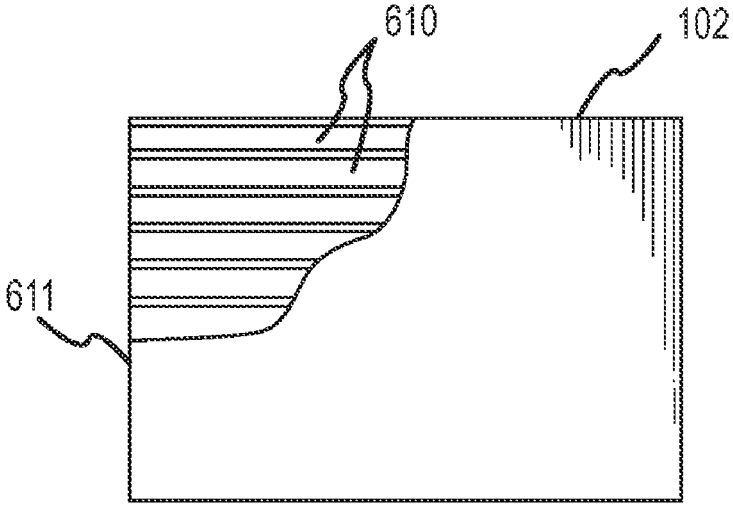
FIG. 6 is a partial cutaway view of a hazard control system having multiple parallel, isolated channels.
Figure 7:
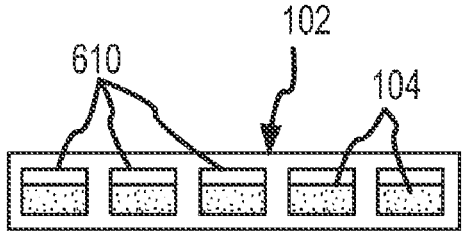
FIG. 7 is a cross-section view of the hazard control system of FIG. 6.

The hazard control system 100 may be configured in any suitable manner for a particular application, such as to enhance or direct dispersal of the control material 104, facilitate adaptation to multiple applications, reduce weight and/or cost, fit to particular objects, mitigate one or more different hazards, and the like. Referring to FIGS. 6 and 7, an alternative housing 102 includes multiple channels 610. The channels 610 are suitably configured to contain the control material 104 for release. The channels 610 may be configured in any suitable manner and formed by any appropriate structure. For example, the channels 610 may be formed by the core 112 or on one or more of the face sheets 106, the frame 108, and/or other parts of the housing 102.

In the present embodiment, the channels 610 are formed by raised partitions formed on an interior surface of at least one of the face sheets 106. Consequently, no core 112 is included. Alternatively, the housing 102 may include the core 112 to form the channels 610, and the frame 108 may also include structure, such as protruding partitions or other suitable structure, to form all or part of the channels 610.

In addition, the channels 610 may be formed in any appropriate manner to maintain the position of the control material 104, facilitate dispersal of the control material 104 upon occurrence of the trigger event, provide ease of manufacturing and/or installation, or any other purpose. In the present embodiment, the channels 610 are configured to form individual parallel channels 610. Alternatively, the channels 610 may be configured in a serpentine pattern, diagonal channels 610, a combination of diagonal, horizontal, vertical, and/or otherwise oriented channels 610.

Figure 10A:
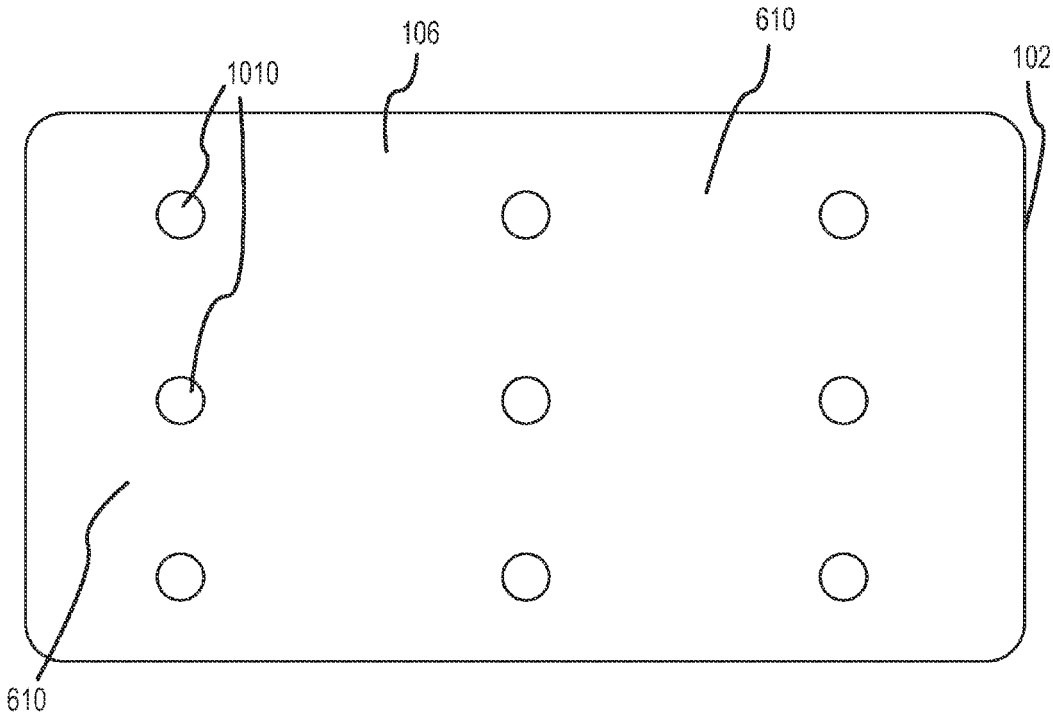
FIG. 10A-B are top and cross-section views, respectively, of a hazard control system having multiple perpendicular, interconnected channels.
Figure 10B:
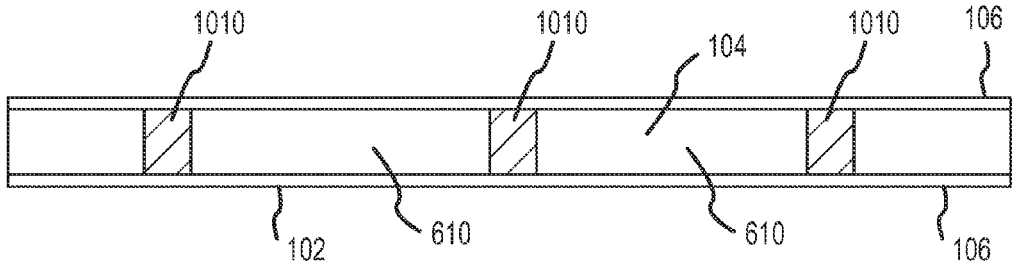

Further, the channels 610 may run in any suitable direction, and may be interconnected. For example, referring to FIGS. 10A-B, the channels 610 may run horizontally and vertically through the housing 102. The channels 610 are defined by partitions 1010. The partitions 1010 may also maintain separation between the face sheets 106, and may also provide attachment points for connecting the two face sheets 106 together, for example using an adhesive, to form the housing 102. The partitions 1010 may comprise any appropriate configuration, such as square, circular, or rectangular partitions, and may be formed in any suitable manner, such as by collectively forming a separate core 112 or by being formed on or attached to one or more face sheets 106. Such partitions 1010 may also be included in configurations using individual channels or compartments, such as channels or compartments that are hermetically sealed from one another, for example to provide additional rigidity.

The housing 102 may also include structural components to provide rigidity, such as ribs formed in the housing 102. In addition, the face sheets 106 may be joined by an adhesive 1114 that has limited bond strength, sufficient only for normal operational environments. The limited strength of the adhesive suitably provides minimal impedance to crack propagation of the second face sheet 1112, facilitating separation of the second face sheet 1112 (in its entirety or in pieces) from the partitions 1010.

Figure 8:
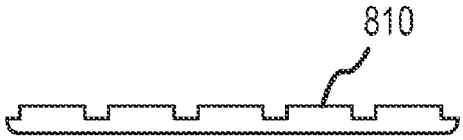
FIG. 8 is an illustration of an end cap.

To enclose the housing 102, the housing 102 edges may be sealed, for example using tape or caulk. Referring to FIGS. 6 and 8, the housing 102 of the present embodiment is closed along an edge 610 with an end cap 810. The end cap 810 may be connected to the face sheets 106 in any suitable manner, for example by being snapped, glued, adhered, fastened, or otherwise attached to the edge 610. The end cap 810 may comprise any suitable material, such as rubber or other resilient material, to be pressed into the edge 610 of the housing 102.

Figure 11:
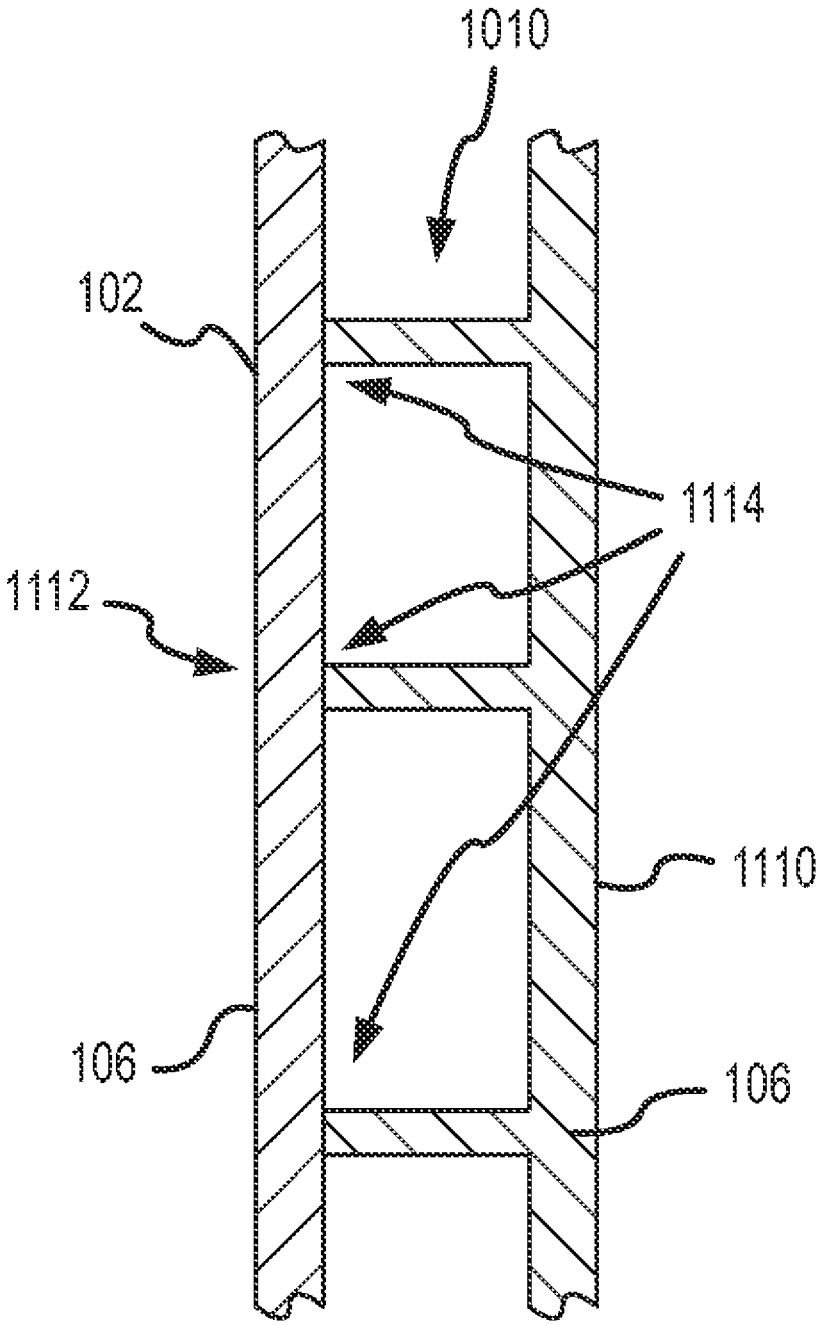
FIG. 11 is a cross-section view of a hazard control system having partitions integrated into a face sheet and bonded to another face sheet by an adhesive.

The housing 102 may include any appropriate materials to facilitate response to the trigger event, provide manufacturing efficiency, reduce weight, or satisfy any other appropriate criteria. For example, referring to FIG. 11, the housing 102 may be configured to aid in its full discharge of extinguishing chemical in response to a trigger event including an impact. To facilitate greater breakup of the housing 102 upon impact, first face sheet 1110 and partitions 1010 may be formed of a first material that is relatively inexpensive and strong, such as in one piece of polycarbonate, and the second face sheet 1112 may comprise a material more prone to total breakage when impacted, such as acrylic or styrene. Alternatively, the housing 102 may be completely formed of a single material, such as acrylic, styrene, styrenics polymer, polyphenylene, polypropylene, and/or polycarbonate. In the present embodiment, the housing 102 comprises a material having desired brittleness and durability and demonstrating favorable fabrication features, such as a plastic, alloy, ceramic, composite, metal, fiber, and/or glass. The particular material and configuration may be selected according to the particular application.

In one embodiment, the housing material may be treated to improve the various characteristics of the housing material. For example, the housing 102 may comprise a first material having desirable brittleness, such as acrylic, styrene, styrenics polymer, or the like, and a second polymer, such as a fiber, polycarbonate, or another type of acrylic, styrene, styrenics polymer, or the like, configured to improve the characteristics of the first material, such as the ductility to improve the workability of the material. For example, the housing material may comprise a first styrenics polymer having a high brittleness and a second styrenics polymer mixed with the first to lower the melting temperature of the overall housing material and otherwise improve the manufacturing characteristics of the material. The ratio of the first material to the second material may be selected according to the desired characteristics of the housing 102. For a high brittleness material, the second material may comprise only a small amount, such as about 10% by weight or less, of the overall material. For improved ductility during manufacturing, the second material may comprise a larger amount, such as about 50% or more of the overall material. In one embodiment, the first brittle material comprises about 60-80% of the overall material, and the second material comprises about 20-40% of the overall material. A suitable material may comprise approximately 70% of the first material and about 30% of the second material.

An alternative embodiment of the housing 102 includes multiple compartments for containing the control material 104. Each compartment may be fully enclosed or connected to one or more other compartments. For example, each compartment may be fully enclosed and individually filled with the control material 104. Alternatively, a compartment may be connected to another compartment so that both compartments may be filled by accessing a single compartment. Using multiple compartments suitably facilitates cutting the housing 102 to a selected size.

Figure 12:
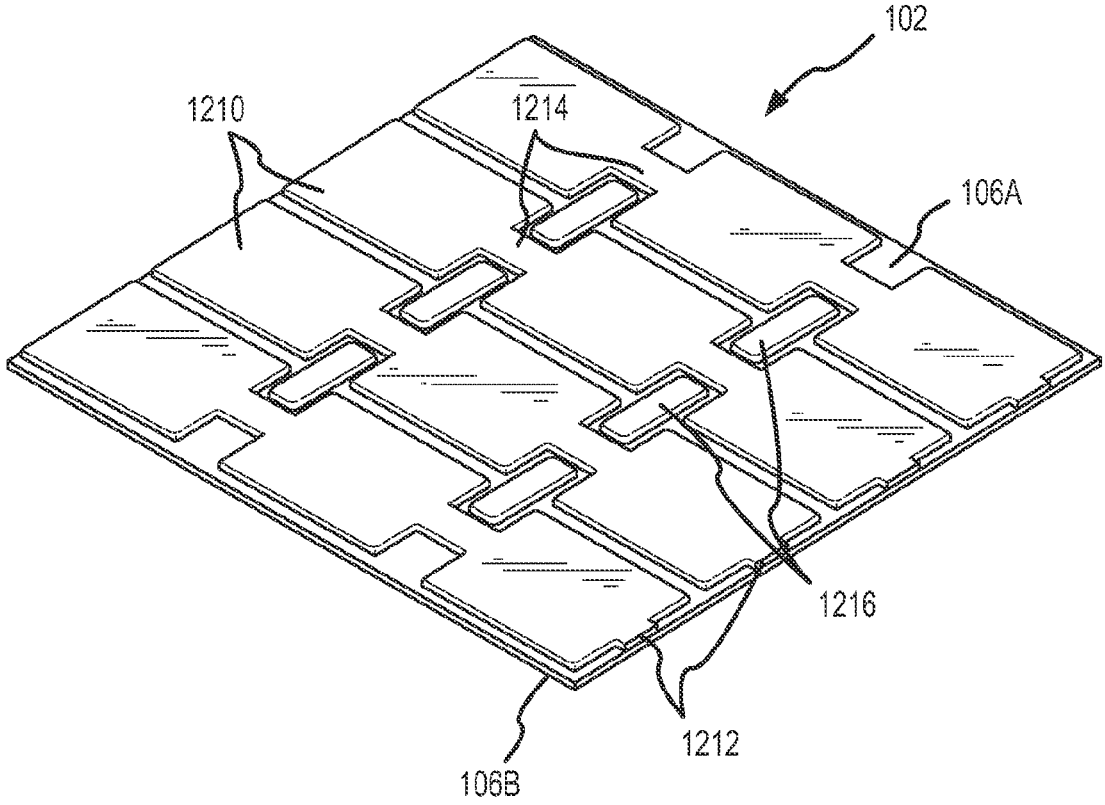
FIG. 12 is an illustration of a hazard control system having multiple interconnected compartments.

For example, referring now to FIG. 12, an alternative housing 102 includes multiple compartments 1210 containing the control material 104. The compartments 1210 may have any appropriate shape or size, such as approximately three inch by five inch rectangles. The housing 102 may form the compartments 1210 in any suitable manner. In addition, the compartments 1210 may be oriented in any manner, such as in rows parallel to an axis of the housing 102 or one or more of the face sheets 106.

In the present embodiment, the housing 102 comprises two face sheets 106A-B. At least one of the face sheets 106A includes multiple indentations to form the compartments 1210. For example, the second face sheet 106B may be flat and the first face sheet 106A may be configured to include multiple indentations in the form of the compartments 1210. The compartments 1210 are suitably formed in rows parallel to a longitudinal axis of the face sheets 106.

The two face sheets 106 are joined in any suitable manner so that the second face sheet 106B covers the indentations in the first face sheet 106A to form the compartments 1210. The compartments 1210 may, however, be formed in any suitable manner, such as by indentations in the second face sheet 103B, compartments formed by the core 112, independent bladders, a quilted bladder having multiple pockets, and the like.

The compartments 1210 of the present embodiment are suitably connected to allow control material 104 to flow between the interconnected compartments 1210. The compartments 1210 may be interconnected in any suitable manner, such as via openings 1212 formed along one or more sides or other surfaces of the compartments 1210. Further, the openings 1212 may be connected in any suitable manner, for example via one or more ducts 1214 connecting the openings 1212. The connections between the compartments 1210 may be implemented in any appropriate manner, such as using tubes attached to the compartments 1210, indentations in one or both of the face sheets 106, inclusion of a core 112 including the ducts 1214, and the like. In the present embodiment, the ducts 1214 are formed by indentations formed in the first face sheet 106A adjacent the indentations used to form the compartments 1210.

In addition, the housing 102 may include any other desired structures to lend desired characteristics to the housing 102, such as to add stiffness, provide mounting surfaces or mechanisms, and the like. For example, in the present embodiment, the first face sheet 106A may include rectangular indentations 1216 formed between the duct indentations 1214 to reduce the surface-to-surface contact between the face sheets 106 and promote crack propagation.

In the present embodiment, each compartment 1210 along two edges of the housing 102 has at least one opening 1212 in one side which is connected to a duct 1214. Each compartment 1210 in the interior of the housing 102 and along the other two edges of the housing 102 has two openings 1212 on opposite sides of the compartment 1210. The openings 1212 are connected to the openings 1212 of the other compartments 1210 via the ducts 1214 to form connected compartments. Consequently, the control material 104 may move between the compartments 1210 through the openings 1212 and ducts 1214. Referring again to FIG. 12, each duct 1214 comprises at least one wall that is distinct from the wall of any other duct and/or connected compartment 1210. Additionally, the perimeter and/or area formed by each duct 1214 is less than the perimeter and/or area formed by an adjacent connected compartment 1210.

The hazard control system 100 may be configured for a selected environment, a selected hazard, and/or a selected trigger event. For example, the hazard control system 100 may be adapted for use with vehicle fuel tanks, storage tanks, fuel or chemical transfer lines, connectors, valves, and other components, oil containers and oil pans, battery compartments, engine compartments, or other applications. In addition, the hazard control system 100 may be configured to control flammable materials, toxic materials, caustic or corrosive materials, or other harmful materials. Further, the hazard control system 100 may be configured to respond to any suitable trigger event, such as an impact, exposure to heat, exposure to a particular substance, or detection of a hazardous condition.

Figure 3:
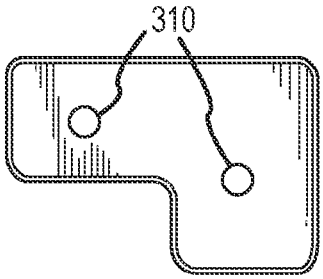
FIG. 3 is an illustration of a housing configured for a fuel tank.

For example, the hazard control system 100 may be specifically configured for particular applications by shaping the housing 102 to conform to a selected surface. For example, referring to FIG. 3, an exemplary housing 102 substantially conforms to the exterior of the fuel tank. Clearance holes 310 accommodate fittings and exterior connections to the fuel tank. Grommets may also be installed in the clearance holes 310.

Figure 13A:
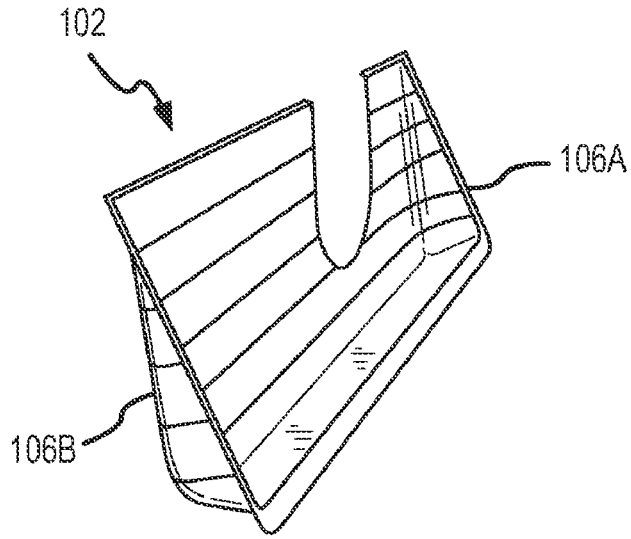
FIGS. 13A-B are perspective and top illustrations, respectively, of a hazard control system conformed to the shape of a fuel tank.
Figure 13B:
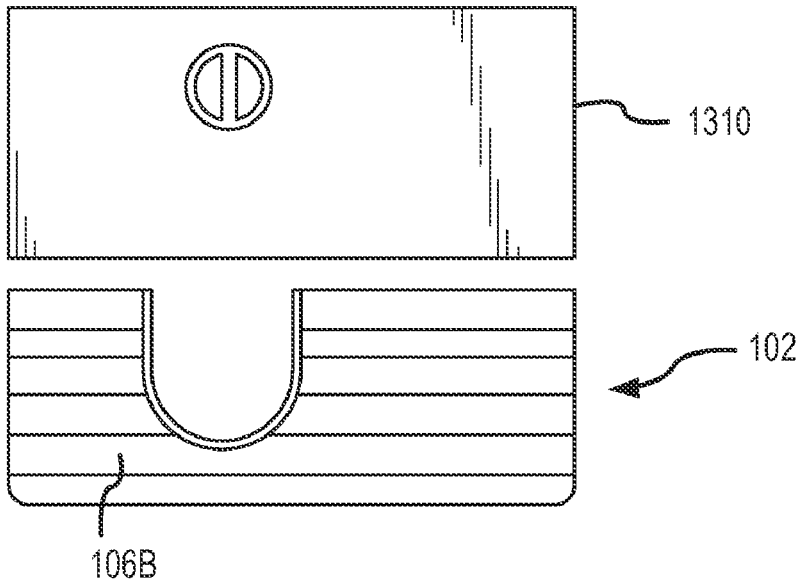

Referring to FIGS. 13A-B, an alternative embodiment of the housing 102 may be configured to conform to the interior or exterior shape of a fuel tank 1310 for police vehicle, such as a Ford Crown Victoria Police Interceptor, a bus, or a motorsports car. In the present embodiment, the first face sheet 106A has an outer surface that is configured to substantially mate with an exterior surface of the relevant fuel tank 1310, such as the top, rear, front, or side of the fuel tank 1310. The outer surface of the second face sheet 106B is configured to conform to the space requirements of the vehicle, such as to fit within the fuel tank area or the trunk of the vehicle.

The housing 102 may be configured in any suitable manner to contain the control material 104, such as a fire suppressant, and shatter upon impact to release the control material 104. In the present embodiment, the housing 102 includes partitions formed in at least one of the face sheets 106 to form the compartments 1210 and suitably the ducts to interconnect the compartments 1210 as shown in FIG. 12. The face sheets 106 are suitably bonded together using an adhesive.

Figure 4:
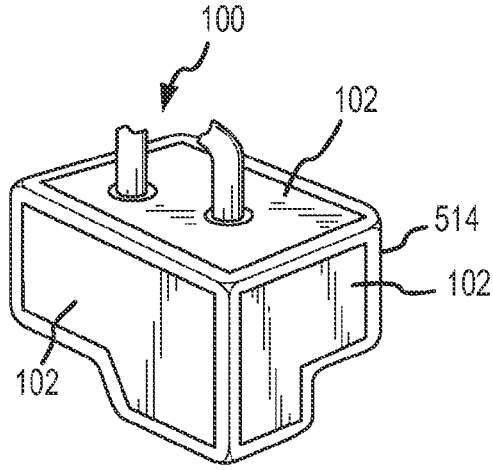
FIG. 4 is an illustration of a hazard control system having multiple panels around a fuel tank.

Referring to FIG. 4, an alternative hazard control system 100 according to various aspects of the present invention comprises multiple housings 102. Each housing 102 conforms to the respective outer surfaces of the fuel tank 514, and may be attached to the fuel tank 514 in any suitable manner, such as via an adhesive. Alternatively, the hazard control system 100 may comprise a single structure or multiple interconnected structures surrounding the exterior or disposed within the interior of the fuel tank 514.

In an alternative embodiment, the hazard control system 100 may be configured for adaptation to any particular application using one of more housings 102. For example, multiple housings 102 may be attached to a fuel tank 514 or other structure to facilitate hazard mitigation. In addition, the housings 102 may be cut to a selected size and/or shape for a particular application.

Figure 14A:
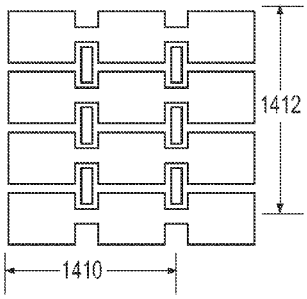
FIGS. 14A-C are illustrations of a hazard control system being cut to a desired size.
Figure 14B:
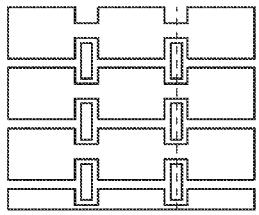
Figure 14C:
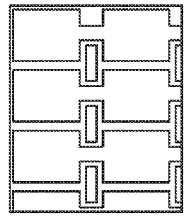

For example, referring again to FIG. 12, the housing 102 may be cut to an approximate desired width and length. Any compartments 1210 that are opened due to the cutting may be emptied of control material 104. Referring to FIGS. 14A-C, a housing 102 is configured to be cut to a desired width 1412 and length 1410. To cut the width, the bottom portion may be cut away (FIG. 14B). Although the cutting opens a series of compartments, several other compartments remain intact. Thus, the hazard control system 100 remains functional.

To cut the length, a length of the housing 102 may be cut away (FIG. 14C). By cutting the length, multiple compartments may be opened, which may remain empty. The ducts leading to the empty compartments may then be closed, for example using putty, tape, caulk, epoxy, a resilient plug, or other mechanism. Thus, the control material 104 remains within several compartments of the housing 102. In the present embodiment, the compartment spacings are configured to permit cutting between the cells, to leave a sealing flange, such that only fill ports connecting the cells in each row remain exposed for filling. Consequently, the housing 102 may be cut after being filled with the control material 104 to reduce unfilled panel material around the perimeter.

The hazard control system 100 may be attached to or associated with a hazard source in any appropriate manner. In various applications, the hazard control system 100 may be placed adjacent to or above the hazard source. Alternatively, the hazard control system 100 may be attached to or abut the hazard source. Any appropriate system or mechanism may fix the hazard control system 100 in position. For example, the housing 102 may be adhesively attached directly to the fuel tank 514, such as via a peel-and-stick adhesive tape. The housing 102 may also be attached to other areas in proximity of the fuel tank 514, such as the inside of the vehicle body panels, and can be attached by any other suitable mechanism, such as tape, straps, rivets, clips, hook-and-loop fasteners, or other fasteners.

Figure 15:
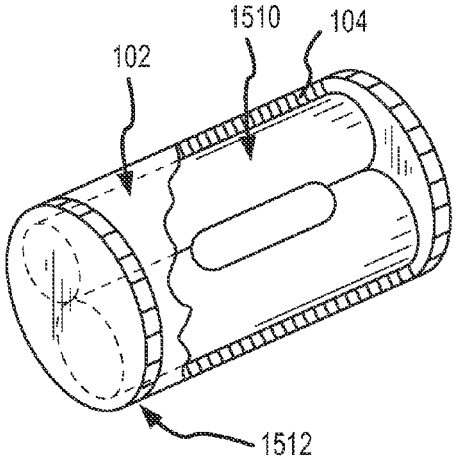
FIG. 15 is a partial cutaway view of a fuel pump shrouded with a hazard control system.

In another embodiment, the hazard control system 100 may be adapted for a particular component that may be susceptible to causing a hazard. For example, referring to FIG. 15, the housing 102 is adapted to conform to a fuel pump 1510, such as for an internal combustion engine. The housing 102 is suitably configured to fit over the fuel pump 1510, such as by vacuum forming, blow molding, or other suitable process. The housing 102 may be connected to the fuel pump 1510, such as via a press fit, outer band clamps, or internal adhesive. The hazard control system 100 may also include a separate end plate 1512 that is attached (adhesively or otherwise) to the end of the housing 102 near the outer end of the fuel pump 1510, particularly if simple cylindrical geometries are applicable. The housing 102 may be configured according to any appropriate design to facilitate dispersal of the control material 104 in response to the trigger event. In one embodiment, the housing 102 is configured with channels 610 between thin double-walled plastic face sheets 106. The control material 104 is disposed within the channels 610 or compartments 1210 of the housing 102.

The housing 102 is suitably configured such that when the fuel pump 1510 is impacted sufficiently (such as in an accident) to break off or partially disconnect the fuel pump 1510 from the engine, facilitating the discharge of its flammable fluid contents and its subsequent ignition, the housing 102 should also break apart due to the same impact, releasing a cloud of suppressant around the region of fluid discharge to mitigate ignition and any resultant fires. The hazard control system 100 may be similarly adapted for other reservoirs and components, including superchargers and turbochargers, power steering pumps, vapor canisters, brake master cylinders, oil pumps, washer fluid reservoirs, fuel pressure reduction valves, and other valves attached to fluid vessels such as those on compressed natural gas (CNG) tanks, liquefied petroleum gas tanks (LPG), hydrogen tanks, and other alternate fueled vehicles.

Figure 16:
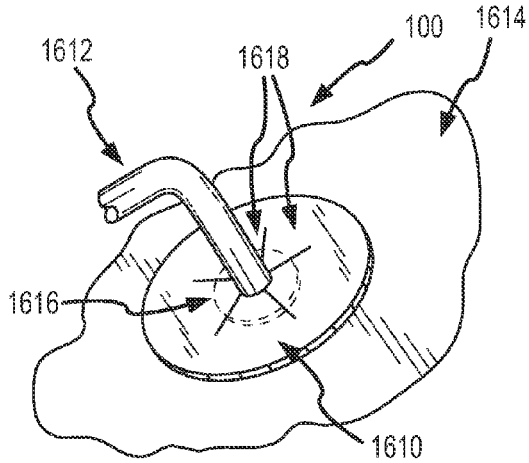
FIG. 16 is a view of a fluid reservoir fitting surrounded by a hazard control system at the location of connection of the reservoir to the fluid line.

The hazard control system 100 may also be adapted to fluid lines and connectors to control hazards in the event of the trigger event. For example, referring to FIG. 16, the hazard control system 100 is configured for a connection point of a fluid line 1612 to a fluid reservoir 1614. The hazard control system 100 suitably includes a housing 102 in the form of a ring 1610 or similar shape that covers the attachment point of the fluid line 1612 and reservoir 1614 and attached to the surrounding face of the reservoir 1614. The ring 1610 has sufficient internal volume to contain enough control material 104 for a particular hazard, such as a dry chemical suppressant to prevent the ignition of any fluids released by the separation of line 1612 and reservoir 1614, for example due to an accident.

The present embodiment also suitably includes a washer 1616 attached to the fluid line 1612. In addition, scored fracture lines 1618 may also be added to the outer faces of the ring 1610. If an event occurs that results in the pulling of the fluid line 1612 sufficiently as to separate it from the reservoir 1614 (such as due to a collision), then the washer 1616 (attached to the fluid line 1612) pulls through the ring 1610, rupturing the ring 1610 and dispersing the control material 104 around the surrounding area to suppress the hazard, such as ignition of fluid discharging from the disconnected line in the local area.

Figure 17:
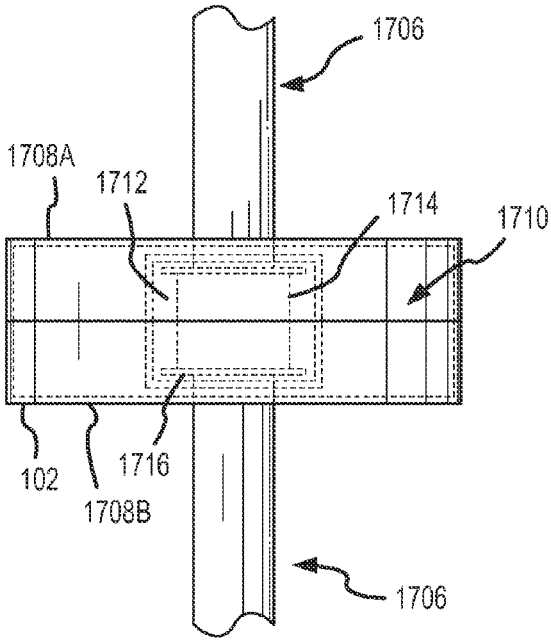
FIG. 17 is a view of a hazard control system fitted for a connector of two fluid line fittings.

The hazard control system 100 may be further configured for controlling hazards at the coupling of two fluid lines 1706. For example, referring to FIG. 17, the housing 102 comprises two disks 1708A-B that are attached to each other, such as by use of an adhesive 1710. The outer surfaces of the disks form cavity 1712 to accommodate a coupling 1714 connecting together two fluid lines 1706. A flange 1716 may be attached to each fuel line 1706, outside of the coupling 1714 but captured within the disks 1708A-B when they are attached together. The outer faces of the disks 1708A-B may also have their surfaces scored radially from their fuel line openings to assist in panel breakup.

If the two ends of the fluid line 1706 are pulled apart (such as due to a collision) and disconnect at the site of the coupling 1714, the flange 1716 of either fluid line 1706 (or both) pulls through the panel disks 1708A-B and shatters them and the control material 104 is released at the same time to inhibit the relevant hazard, such as the ignition of any fluids discharged from the disconnecting lines. The adhesive force between the faces of the disks 1708A-B is designed to be stronger than the force required to fracture either disk 1708A-B by a flange 1716 on either line, to assure that disk fracturing occurs.

Figure 18:
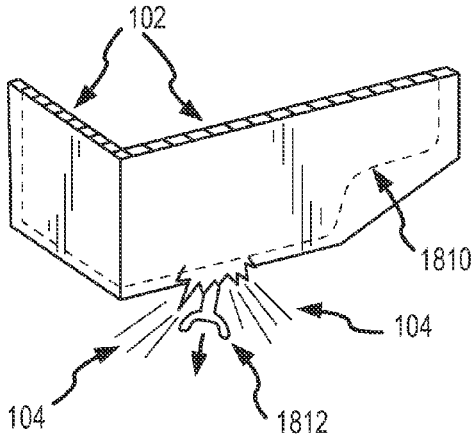
FIG. 18 is an illustration of a hazard control system adapted for an oil pan of an internal combustion engine pierced by a connecting rod.

In another alternative embodiment, the hazard control system 100 may be adapted for controlling a hazard in the event of damage to an oil pan. Referring to FIG. 18, the hazard control system 100 includes a housing 102 over an oil pan 1810, suitably formed as a tightly fitting housing 102 which has been molded from liquid plastic or formed from double wall material, a rectangular formation of flat double-wall panels in the general shape of the oil pan 1810, or other suitable configuration. The housing 102 is attached to the oil pan 1810 by any appropriate mechanism and contains an appropriate control material 104. The housing 102 may extend over the lower engine block as well, in the event of engine failure in other areas. The housing 102 may also be placed as a sheet or curved panel some distance away from the oil pan 1810, but within proximity of the oil pan 1810 sufficient to assure its rupture from the discharged engine components. If the engine to which the oil pan 1810 is attached breaks a connecting rod 1812 and propels it through the oil pan 1810, discharging oil and fuel, the housing 102 also tends to break and discharge the control material 104, for example as a cloud of fire suppressant to prevent the ignition of the released oil and fuel near the exhaust manifold or other ignition sources.

Figure 19:
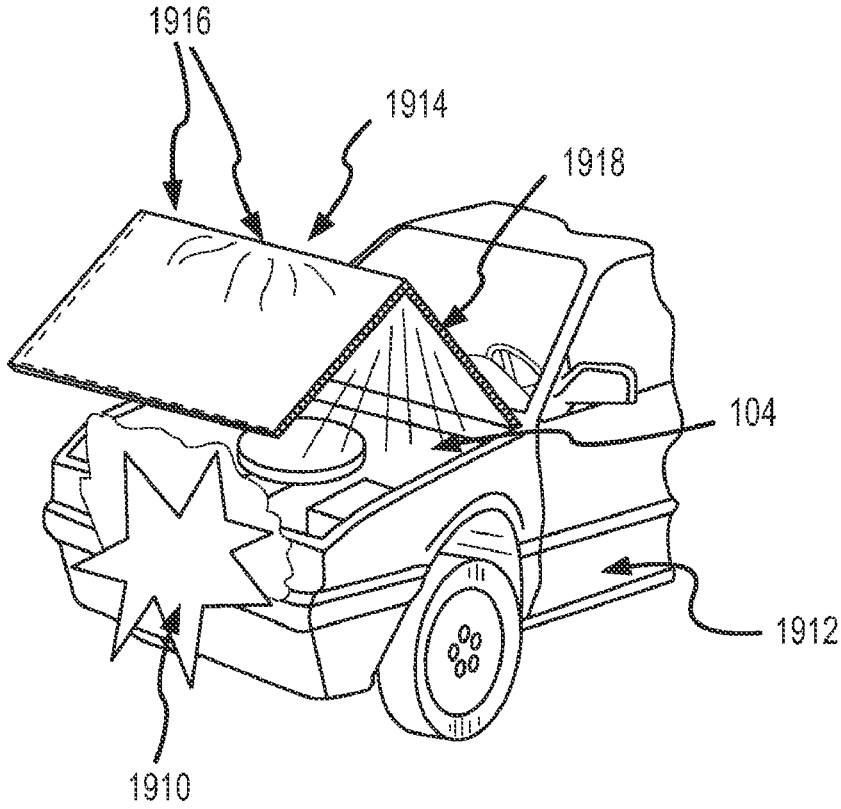
FIG. 19 is an illustration of a vehicle front-end collision, with the engine compartment hood deforming and activating the hazard control system.

In another embodiment, the hazard control system 100 may be configured for controlling hazards in an engine compartment. The hazard control system 100 is suitably configured to diminish a hazard in the event the engine compartment is damaged or another trigger event occurs. For example, the hazard control system 100 may be configured to inhibit fire in the event the engine compartment of a convention automobile is damaged, such as in a front-end collision. Referring to FIG. 19, an exemplary hazard control system 100 includes a housing 102 attached to or integrated into the hood of a car, truck, or other vehicle. The hood is configured to bend near their center point in the event of a front-end impact to dissipate energy and to prevent its disconnection at the hinges, which might possibly drive the hood toward the occupants.

In such a front impact 1910 of a vehicle 1912, the vehicle hood 1914 is configured to deform as normally designed, forming a crease 1916 along a pre-set failure line. In the present embodiment, the housing 102 comprises a hood liner 1918 containing the control material 104, such as a fire extinguishing chemical, for example a dry chemical powder, and formed to the general shape of the underside of the hood 1914. The liner 1918 may have surface coverings to feature sound dampening, or have special sound dampening material added between the liner 1918 and the hood 1914.

When the hood 1914 deforms in a collision, the liner 1918 also deforms until it fractures. The liner 1918 may also include scored lines formed on the surface of the liner 1918 to assist in the breakup of the liner 1918. The control material 104 within the liner 1918 is discharged down onto the engine compartment to prevent any fires or other relevant hazard that might result from the discharge of flammable or otherwise hazardous materials.

Figure 20:
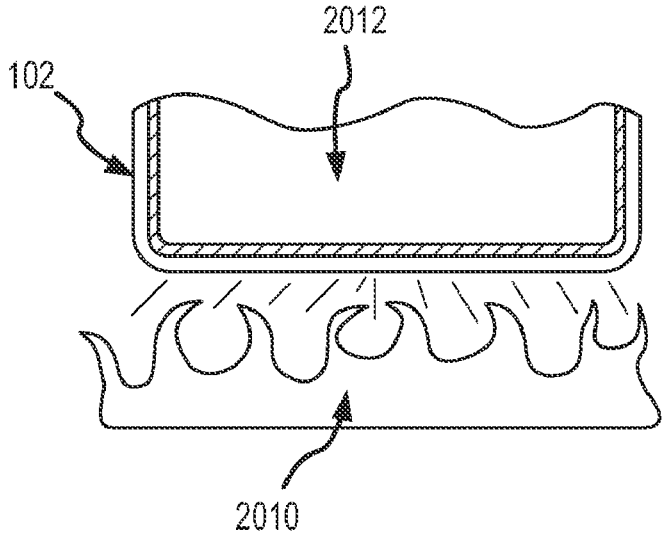
FIG. 20 is a cross-section view of a liquid reservoir having a hazard control system and a pool fire impinging on a liquid reservoir.

In another alternative embodiment, the hazard control system 100 is configured to respond to a thermal trigger event. The trigger event may comprise any appropriate thermal trigger event, such as a sudden rise in temperature or a temperature above a selected threshold. For example, referring to FIG. 20, the thermal event may be generated by a fire 2010 underneath a fluid reservoir, such as a fuel tank 2012. The fuel tank 2012 has a housing 102 adjacent or integrated into the tank containing a control material 104. The housing 102 may be configured in any suitable manner, such as a series of flat panels containing control material 104 placed on the outer surfaces of the fuel tank 2012, a preformed and molded shape that conforms to the outer shape of the fuel tank 2012, or actually molded into the outer surface of the tank 2012 itself. In an exemplary embodiment, when a pool fire occurs underneath the fuel tank 2012, the housing 102 cracks and breaks up, for example due to the resultant thermal loading, and discharges its contents of control material 104, for example to extinguish or mitigate the pool fire or otherwise control a hazard.

The housing 102 is configured to crack and fracture upon exposure to thermal stresses above a selected threshold, such as from a pool fire a few inches from it. For example, the housing 102 suitably includes a bottom face sheet facing the ground constrained by a rigid frame 108 on its perimeter. The face sheet 106 suitably has a higher thermal rate of expansion than the frame 108, such that when the housing 102 is exposed to heat above a selected threshold, the frame 108 restrains the thermal expansion of the bottom face sheet, thus causing stress within the panel to cause its cracking and rupture. Stress can be applied via pre-loading the panels in the frame 108 or by other heat treatments such that minimal additional thermal stresses are required to achieve the fracture condition. Alternatively, the face sheet 106 may melt, peel back, or otherwise move aside upon exposure to heat above a selected threshold. Further, the control material 104 may be configured to swell upon exposure to heat above the selected threshold to cause or supplement the cracking and rupture of the face sheet 106.

If the housing 102 is integrated into a pre-formed fuel tank, for example in conjunction with an outer shell filled with the control material 104, the face sheet 106 to rupture may be pre-loaded by controlling of the forming and post-heating processes. Such techniques may be applied to plastic tanks that are molded and are in abundant use today, but which may be particularly vulnerable to failure when exposed to pool fires established underneath them.

The hazard control system 100 may also be adapted for use in conjunction with nonflammable hazards, such as an enclosure that houses batteries that may be used on an electric vehicle. If such a container is ruptured, such as due to a collision, and the enclosure is ruptured as well as the batteries, caustic and corrosive battery acids can be released to the environment. Such acids pose a hazard to the vehicle occupants, the environment, rescue personnel, and those hired to inspect the wreckage and transport it to a safe area.

A hazard control system 100 according to various aspects of the present invention may be configured for any application where a caustic, corrosive, toxic, or otherwise harmful chemical may be unintentionally released, such as due to a vehicle collision or accident, including tractor-trailers and other transport vehicles that haul such caustic and dangerous chemicals in large quantities. Alternatively, the hazard control system 100 may employ a housing 102 covering or adjacent to the single battery used on virtually all vehicles to inhibit excessive damage resulting from a potential leakage or spray of battery acid within the engine compartment, or toward operators if the battery is damaged in a collision or explodes due to other damage to the battery.

Figure 21:
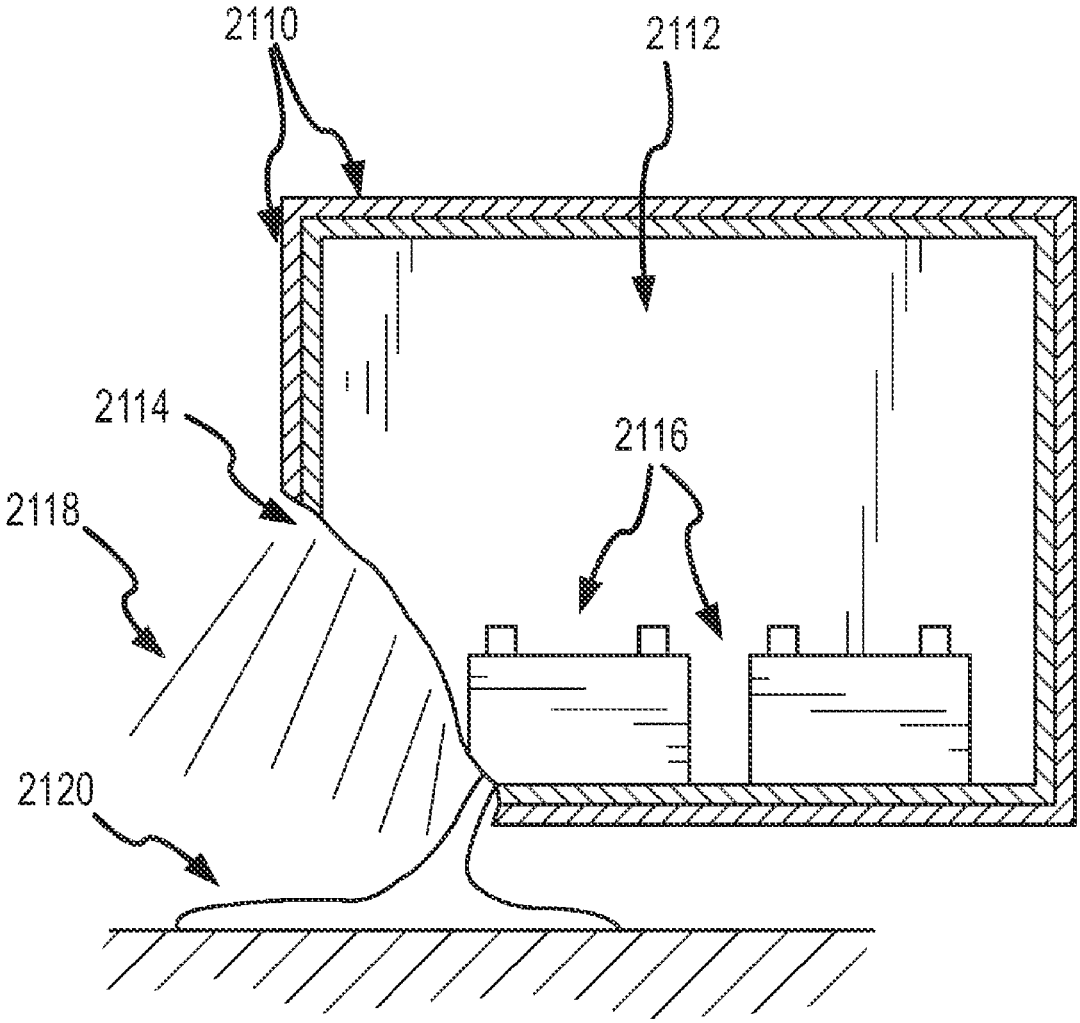
FIG. 21 is a cross-section view of a damaged battery enclosure having an activated hazard control system.

Referring to FIG. 21, in yet another alternative embodiment, the housing 102 comprises one or more protective panels 2110 adjacent a battery enclosure 2112, such as on the exterior and/or in the interior of the battery enclosure 2112. If the enclosure 2112 is damaged, such as in a collision, the battery enclosure 2112 may rupture 2114 and permit the spillage of acid 2120 from the damaged batteries 2116. The protective panels 2110 are also configured to rupture in the event of damage to the enclosure 2112, which facilitates discharge of the control material 104, such as a neutralizing chemical 2118, to control or mitigate the hazard presented by the released acid. The neutralizing chemical 2118 may be any appropriate material, such as sodium bicarbonate.

The various components of the hazard control system 100 may be formed according to any appropriate technique or method. For example, the housing 102 and the core 112 may be cut, cast, extruded, machined, stamped, molded, or otherwise formed to configure to the desired shapes. For example, the housing 102 is suitably vacuum molded, injection molded, or blow molded to form a desired configuration, such as to conform the housing 102 to a particular shape like the exterior of a particular vehicle fuel tank. In particular, the face sheets 106 may be molded so that one exterior surface conforms to the external surface of the fuel tank and the second exterior surface fits within the fuel tank compartment. To form two separate face sheets 106 to be joined with an adhesive, the face sheets 106 are suitably vacuum molded. To form a single integrated housing 102, the housing 102 is suitably blow molded.

In addition, a core 112 may be formed, for example by extrusion. Alternatively, the compartments, channels 610, or other interior structure of the housing 102 may be generated by forming the interior surface of one or more face sheets 106, for example during the molding of the face sheets 106. The face sheets 106 may then be joined to form the housing 102, suitably surrounding the core 112, if desired. If the ends are sealed using end caps, the end caps may be attached, for example after insertion of the control material 104.

The housing 102 is suitably formed of a plastic or other material that may exhibit a grain, or a tendency to more easily crack or shatter in a particular direction. To enhance shattering of the housing 102, the interior structure of the housing 102, such as the core 112, the channel partitions 1010, rows of compartments, or the like, may be configured to extend perpendicularly to the grain. Because the interior structure may tend to support the integrity of the housing 102, extending the interior structure perpendicular to the grain of the housing 102 material may facilitate easier and/or more extensive shattering of the housing 102. Orienting the grain perpendicular to the channels 610 promotes opening of multiple channels or compartments to discharge more control material 104, as the cracks tend to propagate along the grain across multiple channels or compartments.

The control material 104 may be added in any suitable manner, such as before joining the housing 102 components or after assembly of the housing 102. For example, the control material 104 may be added by standing the housing 102 upright and resting on one end and pouring the control material 104 into the upper end of the housing 102. Alternatively, the control material 104 may be added to the individual compartments or channels 610 in any other appropriate manner, such as by inserting the control material 104 directly into each channel or compartment, for example if the compartments or channels 610 are not interconnected. The control material 104 can be poured, injected under pressure, or otherwise inserted into the channels 610.

The access openings for adding the control material 104 are then suitably closed. If the housing 102 uses end caps, the end cap 810 can be snapped into position, substantially sealing the housing 102. Any other relevant system for maintaining the control material 104 within the housing 102 may be implemented, such as sealing the openings with caulk, putty, plugs, membranes, tape, or other mechanism. The hazard control system 100 may then be attached to the relevant hazard source.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The present invention has been described above with reference to a preferred embodiment. However, changes and modifications may be made to the preferred embodiment without departing from the scope of the present invention. These and other changes or modifications are intended to be included within the scope of the present invention.

The invention claimed is:

1. A hazard control system, comprising:
a granular control material; and
a housing, comprising:
a plurality of compartments containing the control material; and
a duct wall defining a duct, the duct connecting at least two of the compartments and configured to facilitate flow of the granular control material between the interconnected compartments, wherein the duct wall is distinct with respect to a wall defining a connected compartment and distinct with respect to any other duct wall, and wherein the perimeter of the duct is less than the perimeter of a connected compartment; and
wherein at least a portion of the housing is configured to shatter to deliver the control material in response to an impact.

2. A hazard control system according to claim 1, further comprising a second duct wall defining a second duct connecting at least the second compartment and a third compartment and configured to facilitate flow of the granular control material between the second and third compartments, wherein the second duct wall is distinct with respect to a wall defining a connected compartment and distinct with respect to any other duct wall, and wherein the perimeter of the duct is less than the perimeter of a connected compartment.

3. A hazard control system according to claim 2, wherein the first duct and the second duct and the compartments are aligned along a common axis.

4. A hazard control system according to claim 1, wherein the housing further comprises:
a flat face sheet having a substantially flat surface; and
a contoured face sheet attached to the substantially flat surface of the flat face sheet, wherein:
the contoured face sheet includes a contoured surface; and
the contoured surface and the flat surface define the ducts and the compartments.

5. A hazard control system according to claim 4, wherein the flat face sheet is configured to shatter in response to the impact.

6. A hazard control system according to claim 1, wherein:
the housing comprises multiple parallel rows of interconnected compartments; and each interconnected compartment is connected only to one or more compartments in the same row.

7. A hazard control system according to claim 1, wherein:

the housing includes a material having a grain; and the housing is configured to substantially rupture across the grain.

8. A hazard control system, comprising:

a plurality of compartments comprising a shatterable material;

a plurality of ducts, wherein each duct comprises a duct wall, wherein each duct wall defines the duct, wherein the duct wall is distinct with respect to a wall defining a connected compartment and distinct with respect to any other duct wall, and wherein the perimeter of the duct is less than the perimeter of a connected compartment; and a granular control material disposed within the compartments.

9. A hazard control system according to claim 8, wherein at least two ducts connected to a single compartment are aligned along a common axis.

10. A hazard control system according to claim 8, further comprising a housing defining the compartments and ducts, wherein the housing comprises:

a flat face sheet having a substantially flat surface; and a contoured face sheet attached to the substantially flat surface of the flat face sheet, wherein:

the contoured face sheet includes a contoured surface; and the contoured surface and the flat surface define the ducts and the compartments.

11. A hazard control system according to claim 10, wherein the flat face sheet is configured to shatter in response to the impact.

12. A hazard control system according to claim 8, wherein:

the plurality of compartments comprises multiple parallel rows of interconnected compartments; and the plurality of ducts connects each compartment only to one or more compartments in the same row.

13. A hazard control system according to claim 8, wherein:

the compartments include a material having a grain; and the compartments are configured to substantially rupture across the grain.

14. A method of controlling a hazard from a hazard source, comprising:

mounting a housing near the hazard source, wherein the housing comprises:

at least two shatterable compartments; and a duct wall defining a duct between the at least two shatterable compartments, wherein the duct wall is distinct with respect to a wall defining a connected compartment and distinct with respect to any other duct wall, and wherein the perimeter of the duct is less than the perimeter of a connected compartment;

disposing a granular control material in at least one of the shatterable compartments; and transferring the solid control material between the at least two interconnected channels via the duct.

15. A method of controlling a hazard according to claim 14, further comprising cutting the housing to a desired size.

16. A method of controlling a hazard according to claim 15, wherein cutting the housing to the desired size comprises cutting through the ducts and not cutting through the compartments.

17. A method of controlling a hazard according to claim 14, wherein the housing further comprises:

a first face sheet configured to substantially maintain integrity when a trigger event occurs; and a second face sheet configured to shatter when the trigger event occurs.

18. A method of controlling a hazard according to claim 17, wherein:

at least one face sheet comprises a substantially flat surface; and at least one face sheet comprises contoured surface;

wherein the substantially flat surface is disposed adjacent the contoured surface, and the substantially flat surface and the contoured surface define the ducts and the compartments.

19. A method of controlling a hazard according to claim 14, wherein:

the housing comprises multiple parallel rows of interconnected compartments; and each interconnected compartment is connected only to one or more compartments in the same row.

20. A method of controlling a hazard according to claim 14, wherein:

the housing includes a material having a grain; and the housing is configured to shatter across the grain.

* * * * *